US006336302B1

(12) United States Patent
Brugman et al.

(10) Patent No.: US 6,336,302 B1
(45) Date of Patent: Jan. 8, 2002

(54) PANEL END CONNECTOR AND LOCKING CLIP

(75) Inventors: Johannes Antonius Hendricus Brugman, Papendrecht; Hans Kurt de Goey, Capelle a/d Ijssel, both of (NL)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 09/396,544

(22) Filed: Sep. 15, 1999

(30) Foreign Application Priority Data

Sep. 15, 1998 (EP) ..... 98203081
Sep. 25, 1998 (EP) ..... 98203221

(51) Int. Cl.[7] ..... E04B 2/30

(52) U.S. Cl. ..... 52/483.1; 52/489.1; 52/792.1; 52/796.1

(58) Field of Search ..... 52/483.1, 489.1, 52/792.1, 796.1, 506.08, 762, 713, 578–581, 588.1

(56) References Cited

U.S. PATENT DOCUMENTS

| | | | | |
|---|---|---|---|---|
| 2,585,082 A | * | 2/1952 | Bollinger, Jr. | |
| 2,648,102 A | * | 8/1953 | Jacobson | |
| 3,606,720 A | * | 9/1971 | Cookson | 52/714 |
| 3,640,557 A | * | 2/1972 | Nute, Jr. et al. | 52/637 |
| 3,645,051 A | | 2/1972 | Kolesar | |
| 4,063,393 A | * | 12/1977 | Toti | 52/245 |
| 4,114,338 A | * | 9/1978 | Beck | 52/478 |
| 4,114,341 A | * | 9/1978 | Vincens | 52/580 |
| 4,257,206 A | * | 3/1981 | Mieyal | 52/573 |
| 4,328,653 A | * | 5/1982 | Anderle | 52/460 |
| 4,494,346 A | * | 1/1985 | Gailey | 52/489 |
| 4,646,506 A | * | 3/1987 | Slapsys | 52/772 |
| 4,949,523 A | * | 8/1990 | Kassem | 52/713 |
| 4,987,715 A | * | 1/1991 | Dunn | 52/489 |
| 5,481,839 A | * | 1/1996 | Lang et al. | 52/235 |
| 5,692,345 A | * | 12/1997 | Mogaki et al. | 52/483.1 |
| 5,842,315 A | * | 12/1998 | Lin | 52/309.9 |

FOREIGN PATENT DOCUMENTS

| | | |
|---|---|---|
| CH | 349398 | 2/1959 |
| CH | 674 537 A5 | 6/1990 |
| EP | 0 137 591 | 11/1984 |
| EP | 0 633 365 A2 | 1/1995 |
| GB | 982775 | 7/1961 |
| GB | 2 052 594 A | 1/1981 |
| NL | 6401479 | 2/1964 |

OTHER PUBLICATIONS

LUXALON® ceiling panel information sheets (3).

* cited by examiner

*Primary Examiner*—Daniel P. Stodola
*Assistant Examiner*—Jennifer E. Novosad
(74) *Attorney, Agent, or Firm*—Dorsey & Whitney LLP

(57) ABSTRACT

A panel connector for connecting adjacent longitudinal ends of a pair of longitudinally-extending elongate panels, where each panel has a pair of upstanding inturned flanges on opposite lateral sides of a central web portion, the panel connector comprising a base member with a first central body having, on laterally opposite sides, a first pair of marginal edges adapted to be engaged between the opposite inturned flanges of each of the elongate panels when the first central body overlies the central web portion of each panel and a hold down member with a second central body having, on laterally opposite sides, a second pair of marginal edges adapted to be engaged between the opposite inturned flanges of each of the elongate panels when the second central body overlies the first central body and wherein the base member and the hold down member are movable relative to one another and a locking clip for use with a paneling assembly comprising a main locking clip for use in a paneling assembly comprising a main body, a pair of arms on opposite sides of the main body and extending generally in the plane of the main body away from its opposite sides, a pair of legs on opposite sides of the bottom of the main body and extending generally downwardly in the plane of the main body, a frontally-extending tab, located vertically and horizontally between the arms and legs and a frontally-extending finger grip on top of the main body.

24 Claims, 8 Drawing Sheets

PANEL END CONNECTOR AND LOCKING CLIP

CROSS-REFERENCE TO RELATED APPLICATIONS

This application corresponds and claims priority to European Application No. 98203081.9 filed Sep. 15, 1998, and European Application No. 98203221.1 filed Sep. 25, 1998. Both applications are incorporated herein by reference as if fully set forth herein.

BACKGROUND OF THE INVENTION a. Field of the Invention

This invention relates to a panel connector or splice for connecting longitudinal ends of elongate wall or ceiling panels in an end-to-end relationship. This invention also relates to a locking clip for increasing the fire and wind resistance of a wall or ceiling paneling assembly and to a method and tool for locking the last panel to be installed in the assembly, as well as for unlocking the first installed panel to be removed from the assembly.

b. Background Art

In the architectural industry, walls and ceilings have often been covered with arrays of prefabricated longitudinally-elongate panels. Such panels have commonly been of a constant, generally channel-shaped cross-section with a substantially flat central web portion and inturned lateral side flanges or rims. These elongate panels have usually been attached to carrier beams and have been conveniently obtained by quasi endlessly roll-forming sheet metal strip into the required channel shape cross-section.

Although such panels can, in theory, be produced in any length to fit a wall or ceiling, the necessary transportation from a manufacturing site to a building site limits the maximum length to about 5 or 6 meters. As a result, end-to-end connections have been required in wall and ceiling installations with dimensions exceeding such maximum transportable lengths of panels.

Several ways of connecting longitudinal ends of elongate panels in an end-to-end relationship have been known. One way, described in UK patent specification GB 982 775, has involved cutting panel ends so as to have mating contours with inter-engaging tongues. Although this construction has resulted in a satisfactory alignment of the visible panel surfaces, it has also required the use of elaborate and expensive cutting and shaping tools, in addition to the cutting tools for making conventional straight end cuts.

Another way, described in U.S. Pat. No. 3,645,051, has involved connecting longitudinal ends of adjacent panels with a separate sheet metal connector. The connector has had a cross-sectional configuration adapted to that of the panels but has been slightly smaller to permit its insertion into the longitudinal ends of adjacent panels, so as to connect them together. In this arrangement, the longitudinal panel ends have been cut straight and have not differed from regular end cuts at the edges of a wall or ceiling installation. With straight cut ends in abutting relationship, the longitudinal ends of adjacent panels should have been in the same plane, with no visible gap being left between the abutting cut edges. However because of difficulties in achieving such a fit between adjacent panels, it has not always been possible to have a flush and inconspicuous transition between the visible surfaces of adjacent panels. It has also generally been difficult to avoid having shadow lines and visible gaps in every end-to-end panel connection.

Also in the architectural industry, wall and ceiling panels have been provided with outwardly directed beads at the free edges of their inturned lateral side flanges. Each bead has been supported by the elongate body of one of a plurality of longitudinally-extending carrier beams. In this regard, the elongate body of each carrier beam has been provided with a plurality of support lugs, spaced along the length of its carrier beam. As described in Swiss patent publication CH 349 398 and U.S. Pat. No. 4,328,653, each support lug has had a stem portion, connecting the lug to the elongate body, and two support surfaces, spaced from the elongate body and extending in opposite longitudinal directions, so that the outwardly directed beads on the flanges of adjacent panels are received on two confronting support surfaces.

It has been easy to install the panels in such paneling systems. It also has been easy to remove the panels in order to gain access to the plenum behind or above the paneling systems. Yet, there has been a demand for a paneling system in which the panels are more securely locked in position and thereby more resistant to being accidentally removed, especially for outdoor installations, for installations in underground railway stations and particularly for installations where fire hazards require that the panels be prevented from falling down too readily during a fire. In this regard, known paneling systems have not always been sufficiently resistant to gusts of wind or maintained their structural integrity long enough during a fire.

It has been proposed in EP 0 137 591 (B1) to use additionally locking elements which are inserted through openings in a carrier body of a carrier beam and which have a tab that can be bent downwardly behind a panel bead engaged on a support surface of a support lug, to prevent the panel from being accidentally removed from the carrier beam. However with such locking elements, it has not been possible to lock the last installed panel in the paneling system, because when it has been time for the last panel to be installed, the locking element positioned in the plenum, has no longer been accessible. As a result, the last panel, to be installed, has had to be left unlocked and thus susceptible to being accidentally removed. Also with such locking elements, it has been cumbersome to intentionally remove panels for access behind or above the plenum because of the necessity to remove the panels in sequence starting from the last installed panel and working towards the panel covering the area where access has actually been needed. This has often required the removal of a substantial number of panels, including panels from areas where access to the plenum was not strictly required. It has also not been easy for persons, without knowledge of the original installation of such systems, to locate or recognize the last installed panel. Furthermore, such locking elements, which have to be bent back when installed, have become unsuitable for reuse and have required replacement after having been removed to gain access to the plenum.

SUMMARY OF THE INVENTION

In accordance with one aspect of this invention, a panel connector is provided which improves the appearance of the connection of adjacent longitudinal ends of a pair of longitudinally-extending elongate panels, such as wall or ceiling panels, in an end-to-end relationship, where each panel has a pair of upstanding inturned flanges on opposite lateral sides of a central web portion; the panel connector of the invention comprises:

- a base member with a first central body having, on laterally opposite sides, a first pair of marginal edges adapted to be engaged between the opposite inturned flanges of each of the elongate panels when the first central body overlies the central web portion of each panel; and a hold down member with a second central body having, on laterally opposite sides, a second pair of marginal edges adapted to be engaged between the opposite inturned flanges of each of the elongate panels when the second central body overlies the first central body;

wherein the base member and the hold down member are movable relative to one another.

Another embodiment of the panel connector of this invention comprises:

the base member; and the hold down member;

wherein the second pair of opposite marginal edges are connected to laterally opposite sides of the second central body of the hold down member by a pair of resilient side portions biasing the second pair of opposite marginal edges away from the first pair of opposite marginal edges; and wherein the second pair of opposite marginal edges are spaced away from the first pair of opposite marginal edges.

Advantageously, the base member and the hold down member are movable only laterally with respect to one another. Also, the second pair of opposite marginal edges of the hold down member are advantageously adapted to cooperate with the opposite inturned flanges of each of the elongate panels to laterally and vertically center the hold down member on the elongate panel and on the base member, between them, particularly when the opposite inturned flanges have a generally U-shaped cross-section with generally inwardly-directed free end portions, confronting one another. Moreover, the first pair of opposite marginal edges of the base member are adapted to laterally center the base member between the opposite inturned flanges of the pair of elongate panels.

In accordance with another aspect of this invention, a wall or ceiling paneling assembly is provided, comprising:

a plurality of elongate panels, each having a pair of inturned side flanges extending in the same generally perpendicular direction relative to a main panel surface; each flange having an outwardly directed bead at its free edge; and at least two elongate carrier beams, each having an elongate body with a longitudinal axis; the longitudinal axes of the carrier beams being in parallel spaced relationship; the elongate body of each carrier beam being provided with a plurality of support lugs spaced along the length of the carrier beam; each support lug of the elongate body of each carrier beam having a stem portion connecting it to the elongate body and two support surfaces spaced from the elongate body and extending in opposite directions along the longitudinal axis of the carrier beam; and each support lug receiving outwardly directed beads of adjacent panels on confronting support surfaces; and at least one locking clip movably connected to the elongate body of each carrier beam for movement between: i) an inactive position, in which the outwardly directed beads of adjacent panels can be engaged by, and disengaged from, the confronting support lug of the elongate body of the carrier beam, and ii) an active position, in which the outwardly directed beads of adjacent panels are prevented from being disengaged from the confronting support lug of the elongate body of the carrier beam.

This paneling assembly does not have the inconveniences of prior paneling assemblies in that its locking clip can be moved between inactive and active positions without bending it. In addition, the locking clip can be hidden but nevertheless reached and activated or deactivated through the closed surface of the completely installed paneling assembly.

Also provided is a locking clip for use in this paneling assembly, comprising: a main body; a pair of arms on opposite sides of the main body and extending generally in the plane of the main body away from its opposite sides; a pair of legs on opposite sides of the bottom of the main body and extending generally downwardly in the plane of the main body; a frontally-extending tab located vertically and horizontally between the arms and legs; and a frontally-extending finger grip on top of the main body. Advantageously, a laterally-extending knee portion is provided at about the middle of the length of each leg. It is particularly advantageous that the arms each have a rear arm portion, an inwardly- and frontally-extending front arm portion and a frontally-extending hand portion. It is quite particularly advantageous that each front arm portion have a downwardly depending tongue.

Further provided are a method and tool which allow any one of the panels in the completely installed paneling assembly to be locked with the locking clip, so that they cannot be accidentally removed or unlocked.

Further aspects of the invention will be apparent from the detailed description below of particular embodiments and the drawings thereof.

DESCRIPTION OF THE PREFERRED EMBODIMENTS

Figure 1:
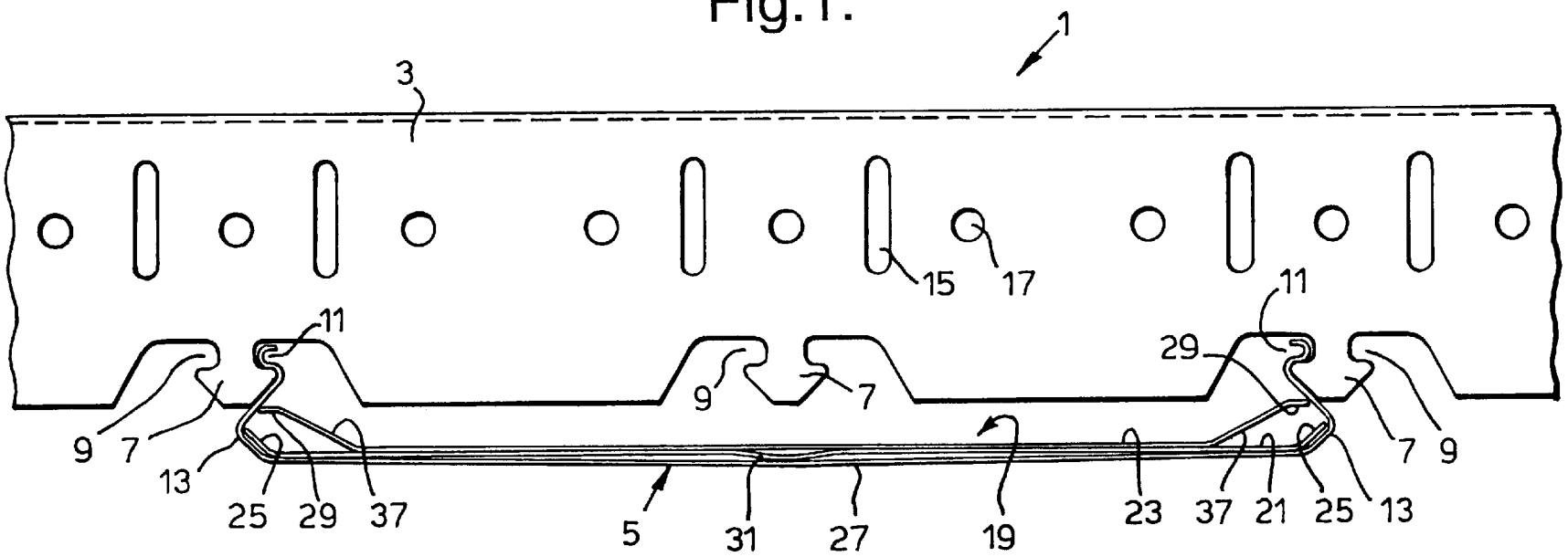
FIG. 1 is a partial elevation view of a first ceiling paneling assembly of this invention, from a longitudinal end of a ceiling panel, engaging a panel connector of this invention.

FIG. 1 shows a portion of a first ceiling panel assembly 1 having a laterally elongate carrier beam 3 which can hold a plurality of longitudinally elongate ceiling panels, generally 5, of which only the longitudinal end of one panel 5 is shown. The carrier beam 3 has a plurality of prongs 7 spaced along its length. The prongs 7 each include at least one laterally open recess 9, preferably two laterally open recesses 9 on laterally opposite sides, to accommodate beads 11 on confronting upstanding inturned flanges, generally 13, on laterally opposite sides of each panel 5.

The carrier 3 is also preferably provided with regularly spaced slots 15 and/or openings 17 which can be used for mounting the carrier on a building structure (not shown) or provide markings for shortening the carrier 3 at predefined locations.

As shown in FIG. 1, a panel connector 19 of this invention, which includes a base member 21 and a hold down member 23, engages the ceiling panel 5. Laterally opposite sides of the base member 21 have a first pair of upstanding marginal edges 25 held between, and engaging, the opposite inturned flanges 13 of the ceiling panel 5 when the base member 21 lies substantially directly atop a substantially flat, central web portion 27 of the ceiling panel 5. The first pair of opposite marginal edges 25 is adapted to cooperate with the inturned flanges 13 of the ceiling panel 5 to laterally center the base member 21 on the ceiling panel 5. As described in detail below, laterally opposite sides of the hold down member 23 have a second pair of upstanding marginal edges 29 that are held between, and engage, the opposite inturned flanges 13 of the ceiling panel 5 and are spaced away above the first pair of opposite marginal edges 25 when the hold down member 23 lies directly atop the base member 21 which lies directly atop the central web portion 27 of the ceiling panel 5.

Each of the second pair of opposite marginal edges 29 is positioned on the free end of an upwardly biased, resilient side portion 37 of the hold down member 23 and is likewise adapted to cooperate with the opposite inturned flanges 13 of the ceiling panel 5 to laterally and vertically center the hold down member 23 on the ceiling panel 5 and on the base member 21, sandwiched between them. In this regard, the opposite inturned flanges 13 of each ceiling panel 5 preferably have a generally U-shaped cross-section, as shown in FIG. 1, where they engage the upstanding opposite marginal edges 25, 29 of the base member 21 and hold down member 23. The preferred U-shaped cross-section of the opposite inturned flanges 13 provides a generally inwardly-directed free end portion on the flange 13 on each lateral side of the ceiling panel, directed towards the inwardly-directed free end portion of the flange 13 on the other lateral side of the ceiling panel 5.

FIG. 1 also shows that the central body 33 of the base member 21 has a longitudinally- and downwardly-extending central dimple or depression 31. The depression 31 is urged against the underlying central web portion 27 of the ceiling panel 5 when the upstanding opposite marginal edges 25 of the base member 21 engage the confronting opposite inturned flanges 13 of the ceiling panel 5 as described below with regard to FIGS. 4 and 6.

Figure 2:
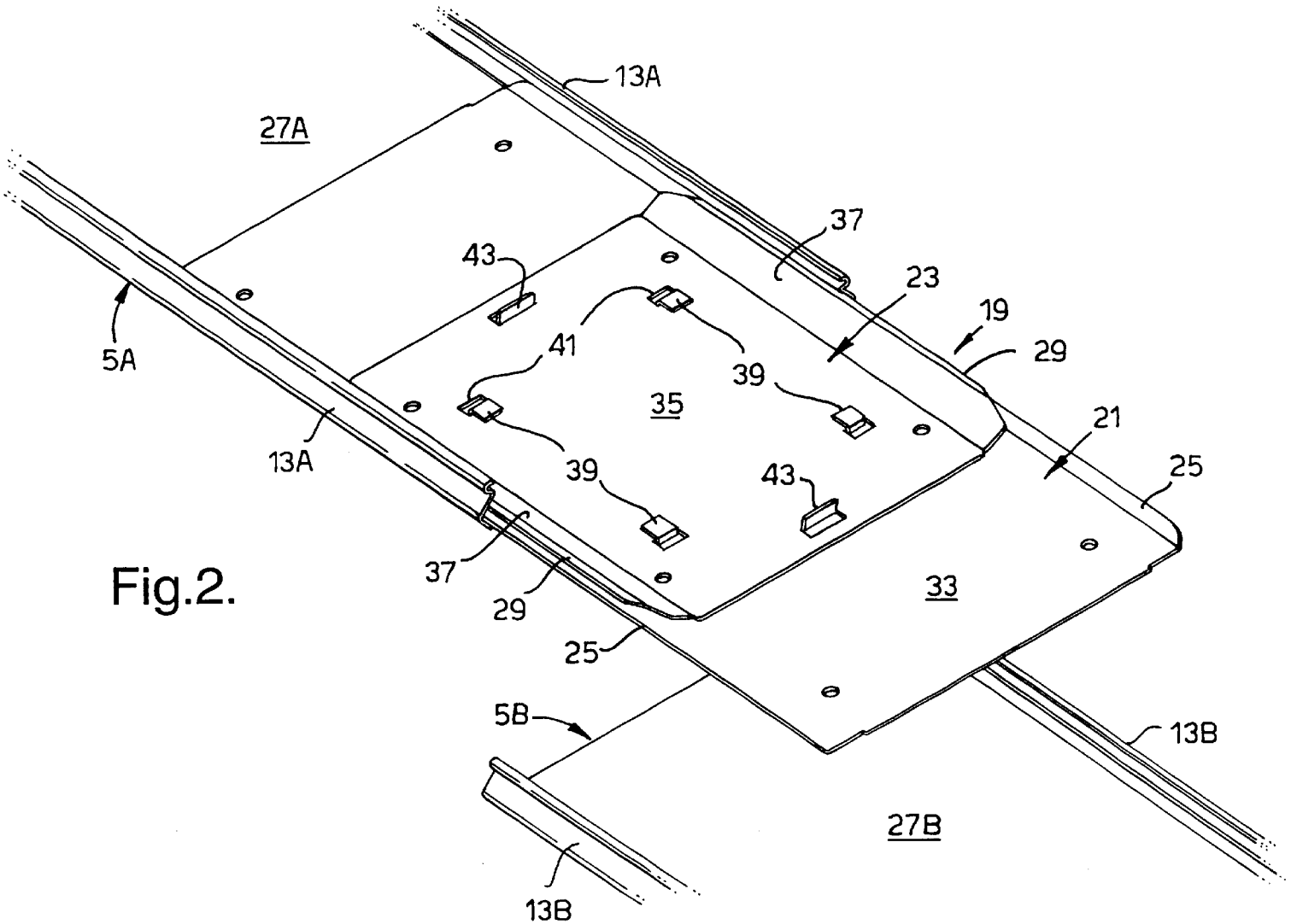
FIG. 2 is a perspective view from above, showing adjacent longitudinal ends of two ceiling panels in a partly exploded assembly and the panel connector of FIG. 1, inserted in one of the longitudinal ends of one of the panels.

FIG. 2 shows one longitudinal end of the panel connector 19 engaging a longitudinal end of a first ceiling panel SA before the other longitudinal end of the panel connector 19 engages the adjacent longitudinal end of a second ceiling panel 5B to form a ceiling panel assembly 1 of this invention. The base member 21 of the panel connector 19 has a substantially flat, central body 33 which will overlie the confronting central web portions 27A, 27B of the first and second ceiling panels 5A and 5B, and the first pair of opposite marginal edges 25 of the base member 21 will thereby be snugly engaged between the most widely separated portions of the confronting upstanding inturned flanges 13A, 13B on laterally opposite sides of each ceiling panel 5A and 5B. The hold down member 23 also has a substantially flat, central body 35 which overlies the flat central body 33 of the base member 21.

The upstanding second pair of opposite marginal edges 29 of the hold down member 23 are each positioned on the free end of a resilient, upwardly biased, side portion 37 on laterally opposite sides of the central body 35 of the hold down member. The resilient side portions 37 of the hold down member 23 are particularly resilient in an upward direction, so that when the hold down member is held between confronting inwardly-directed U-shaped portions of the opposite inturned, flanges 13A, 13B of the adjacent ceiling panels 5A and 5B and the central body 33 of the base member 21, the resilient side portions 37 bias the central body 33 of the base member 21 downwardly against the underlying confronting central web portions 27A, 27B of the panels 5A, 5B.

As shown in FIG. 2, the hold down member 23 preferably is directly held on the base member 21 by tabs 39 that are integrally formed in the central body 33 of the base member and that extend through and engage apertures 41 in the central body 35 of the hold down member. Preferably, the apertures 41 are dimensioned to be significantly larger in the lateral direction than are the tabs 39, so that there can be significant relative movement between the base member 21 and the hold down member 23 in the lateral direction. Preferably, the apertures 41 are also dimensioned to not be significantly larger in the longitudinal direction than are the tabs 39, so that there cannot be significant relative movement between the base member 21 and the hold down member 23 in the longitudinal direction. It has been found that such relative lateral mobility successfully accommodates and eliminates the negative effects of any inaccuracies or distortions which may be present in the shape or configuration of the inturned flanges 13 of ceiling panels 5. Such inaccuracies can result from roll-forming the cross-sections of the ceiling panels 5, and such distortions can result from spring back at the panel ends after cutting, and if not dealt with, they can impair the proper fit of ceiling panels and panel connectors and result in a poor appearance of the end-to-end panel joints in ceiling panel assemblies.

As seen in FIG. 2, the hold down member 23 preferably has a longitudinal length (parallel to its second pair of opposite marginal edges 29) which is smaller than the longitudinal length of the base member 21 (parallel to its first pair of opposite marginal edges 25). The hold down member 23 is also preferably provided with upwardly bent tabs 43 to facilitate manual positioning of the panel connector 19, once it is inserted in the abutting ends and web portions 27A, 27B of the adjacent panels 5A, 5B.

Figure 3:
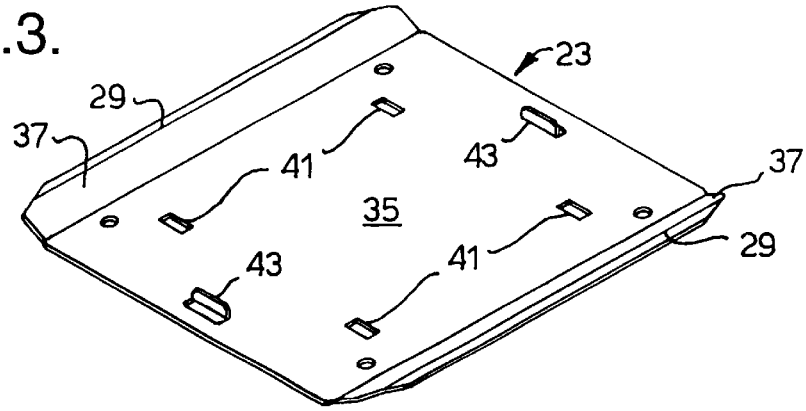
FIG. 3 is a perspective view from above, showing the hold down member of the panel connector of FIG. 1.
Figure 4:
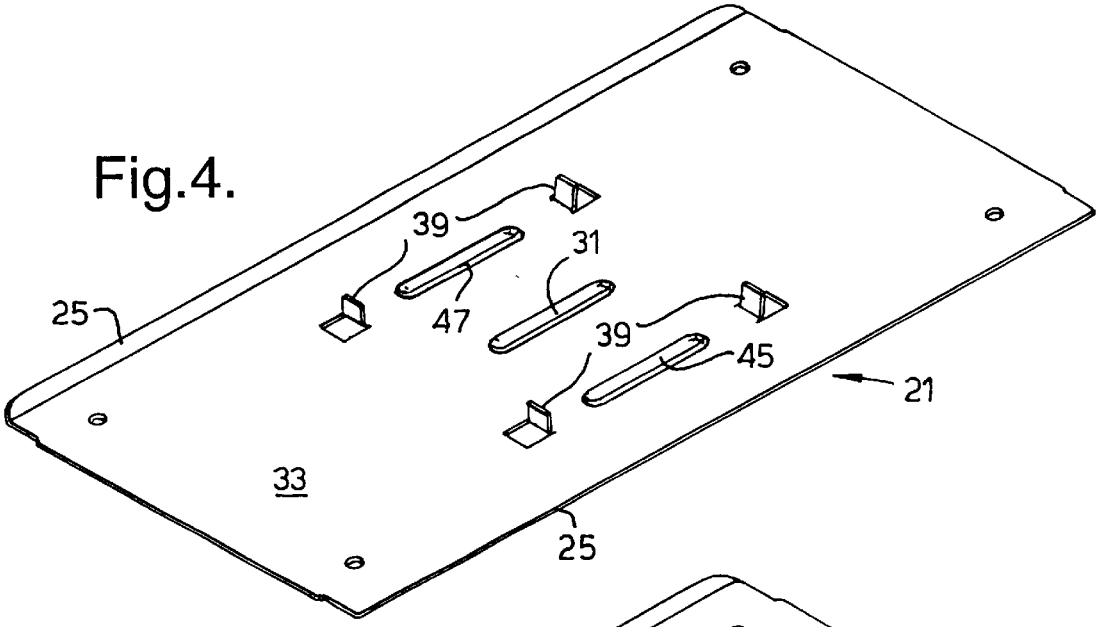
FIG. 4 is a perspective view from above, showing the base member of the panel connector of FIG. 1.

FIG. 3 shows the hold down member 23 of the panel connector 19 of this invention, isolated from the base member 21 (which is shown separately in FIG. 4). The hold down member 23 is adapted to accommodate different positions of the base member 21 on the ceiling panel 5 in a ceiling panel assembly 1, as a result of the shape and size of the apertures 41 in the central body 35 of the hold down member and its resilient side portions 37 carrying its second pair of opposite marginal edges 29. The hold down member 23 also has upwardly bent tabs 43 for holding and manipulating just the hold down member or the entire panel connector 19. Alternatively, upwardly bent tabs (not shown) for holding and manipulating the entire panel connector 19 could be provided on the central body 33 of the base member 21, but there would be a risk of such tabs showing through as a deformation on the visibly exposed side of the central web portion 27 of the ceiling panel 5.

FIG. 4 shows the base member 21 of the panel connector 19 of this invention. Its tabs 39 are shown in an upstanding position, ready to be received in the apertures 41 of the hold down member 23. Also shown in FIG. 4 is the central depression 31 which projects downwardly from the central body 33 of the base member 21, so as to be able to engage the web portion 27 of the ceiling panel 5 in the ceiling panel assembly 1 as shown in FIG. 1. It is preferred that additional longitudinally-extending depressions 45 and 47 are provided on both lateral sides of the central depression 31. The additional depressions 45 and 47 are preferably somewhat shorter and shallower than the central depression 31. As explained below in connection with FIG. 6, the single central depression 31 or optionally the several depressions 31, 45, 47 can assist in vertically aligning the central web portions 27 of the adjacent ceiling panels 5. Because the additional depressions 45, 47 are also generally aligned with the tabs 39 of the base member 21, the additional depressions can assist in hiding any imperfections that may result from the tabs 39 being formed out of the material of the central body 33 and that could be seen from beneath the ceiling panels 5 when the central body is flush with the central web portion 27 of the ceiling panel 5. Such imperfections could, for example, be the apertures left in the central body 33 by the tabs 39, showing through on the visibly exposed side of the central web portion 27 of the ceiling panel 5. By lifting slightly the central web portion 27, this phenomenon can be prevented.

Figure 5:
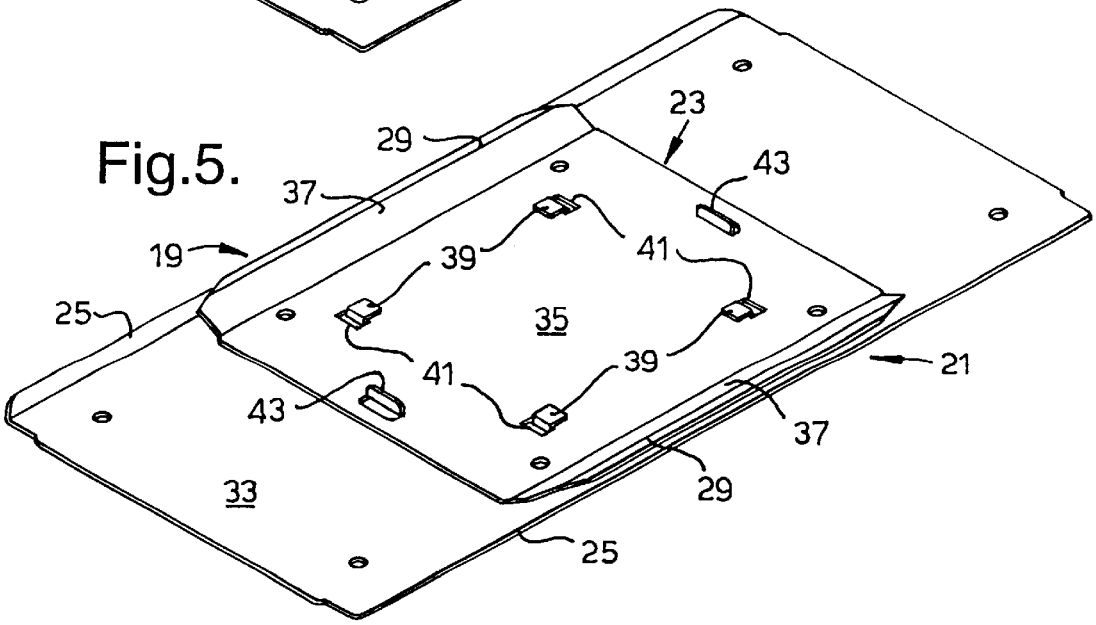
FIG. 5 is a perspective view from above of the assembled panel connector of FIG. 1, using the components of FIGS. 3 and 4.

FIG. 5 shows the base member 21 of FIG. 4 attached to the hold down member 23 of FIG. 3 to form the assembled panel connector 19. The tabs 39 of the base member 21 have been bent longitudinally through another 90 degrees to engage the inwardly facing edges of the apertures 41 of the hold down member to hold the base member and hold down member together but allow them to slide somewhat laterally relative to one another. As so attached, the flat central bodies 33, 35 of the base member 21 of FIG. 4 and the hold down member 23 of FIG. 3 closely overlie one another, although the marginal edges 29 of the hold down member are spaced substantially above the marginal edges 25 of the base member within the inturned flanges 13 of the underlying ceiling panel 5.

Figure 6:
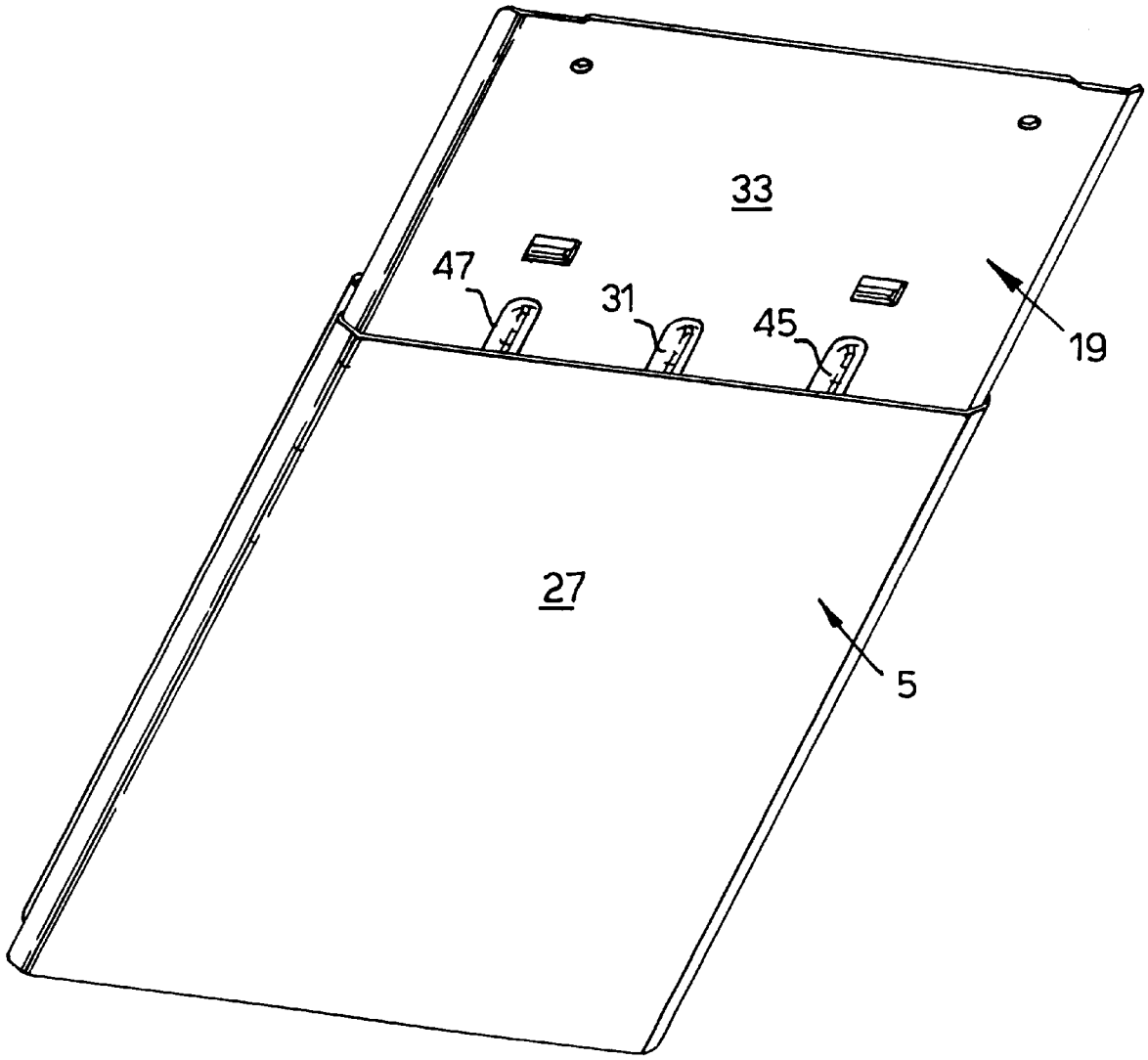
FIG. 6 is a perspective view from below of the panel connector of FIG. 1, inserted in the longitudinal end of a single ceiling panel, showing an additional feature of the panel connector.

FIG. 6 shows the underside of the central web portion 27 of one of the ceiling panels 5 with the panel connector 19 inserted into a longitudinal end thereof. This is the view that would be visible in a room containing the ceiling panel assembly 1. FIGS. 1 and 6 particularly show the cooperation between the central depression 31 in the central body 33 of the base member 21 of the panel connector 19 and the central web portion 27 of one of the adjacent ceiling panels 5. The central web portion 27 of each of the adjacent ceiling panels 5 is forced by the central depression 31, acting on the cut longitudinal end of the central web portion 27, to curve slightly laterally outwardly. This slight curvature greatly enhances the alignment of the cut longitudinal ends of adjacent ceiling panels 5, when joined together by the panel connector 19, and so prevents the formation of shadow lines or gaps between such ends. Alignment of adjacent cut longitudinal ends of ceiling panels 5 is often hampered the so-called "spring back effect" following transverse cutting of roll-formed panels. This "spring back effect" is attributable to a release of inherent tension within the roll-formed shape, and it results in the central web portions 27 of the adjacent ceiling panels 5 becoming slightly concave at their cut longitudinal ends, although most of the remainder of each central web portion 27 retains its intended flat or slightly convex shape. The central depression 31 corrects such distortions at the abutting cut longitudinal ends of the panels 5. Similarly, the additional depressions 45, 47 can provide extra support for the curvature of the abutting cut longitudinal ends of the panels 5, and accordingly, such depressions 45, 47 are preferably smaller than the central depression 31 in accordance with the smaller degree of panel distortion that they resist.

Figure 7:
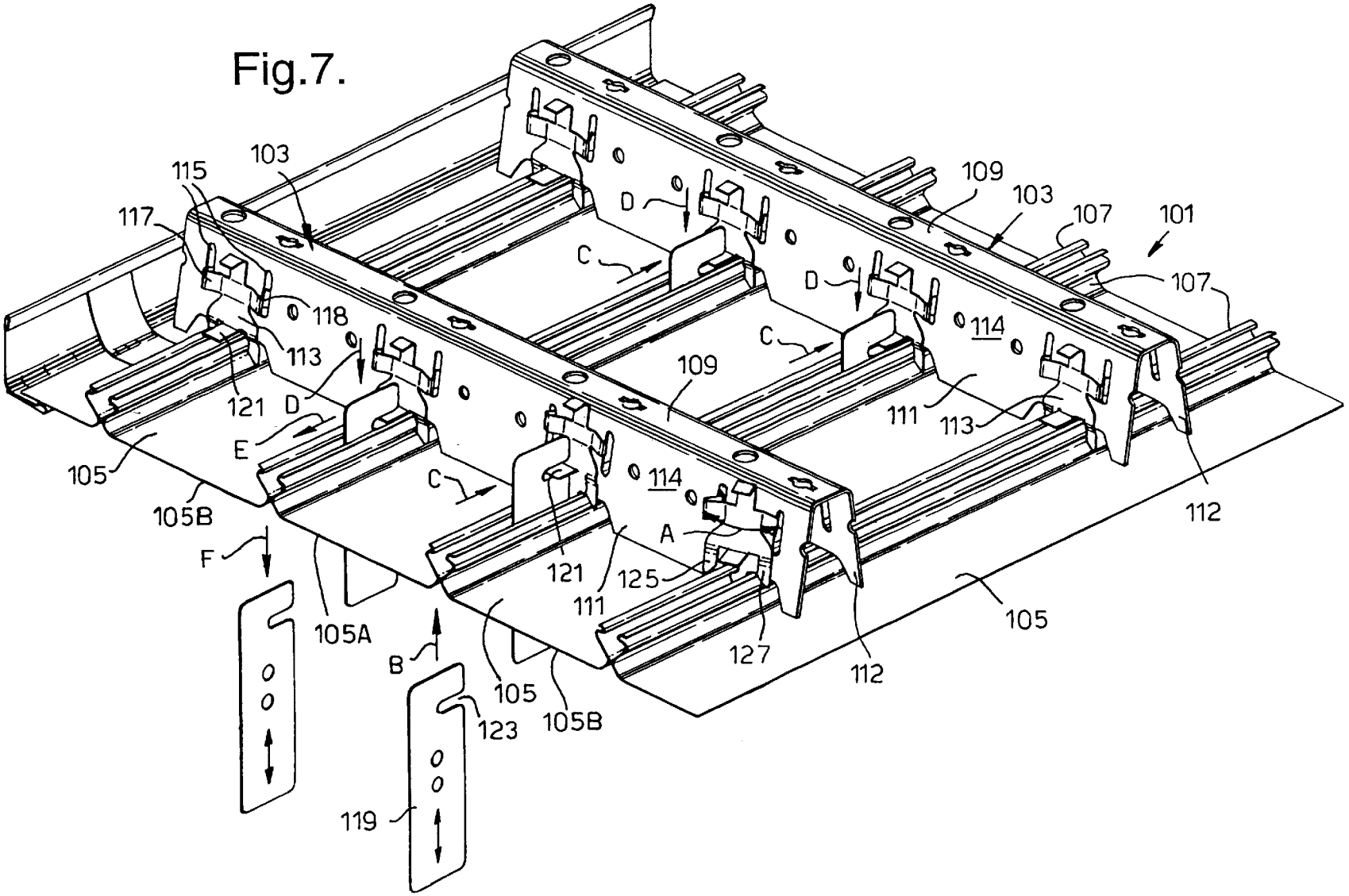
FIG. 7 is a perspective view from above of a portion of a second ceiling paneling assembly of this invention, showing the steps of fitting and locking its last panel with locking clips of this invention.

FIG. 7 shows a second ceiling paneling assembly, generally 101, in a somewhat simplified arrangement, with two longitudinally elongate carrier beams 103. The carrier beams 103 are arranged parallel to one another and, for the purpose of illustration, are shown spaced closer together than they would be in covering an actual ceiling. Transverse to the longitudinal axes of the carrier beams 103 are a plurality of laterally elongate panels, generally 105, in side-by-side relationship. The panels 105 have in-turned marginal side flanges 107 which are engaged by support lugs (not visible in FIG. 7, but generally referenced 129 in FIG. 8) on the carrier beams 103.

The carrier beams 103 each have an elongate body 109 with at least one downwardly depending flange 111, preferably two downwardly depending flanges 111,112. A plurality of upstanding locking clips, generally 113, are slidably attached to an exterior lateral face 114 of one of the depending flanges 111 of each carrier beam 103 in the vicinity of the support lugs (129 in FIG. 8) and hold the side-by-side side flanges 107 of a pair of adjacent panels 105.

The one depending flange 111 of each carrier beam 103 is provided with pairs of adjacent vertical slots 115, in which a pair of arms 117,118 on opposite sides of each locking clip 113 are vertically slidable. The configuration and shape of the arms 117,118 allow the clips 113 to engage the one depending flange 111 of each carrier beam 103 by hooking one arm 117 into one of a pair of vertical slots 115 while maneuvering its other arm 118 in the other vertical slot 115 of the pair as indicated by arrow A in FIG. 7.

Once a locking clip 113 has been mounted on a depending flange 111 of a carrier beam 103 by having the pair of arms 117,118 of the locking clip engage one of the pairs of vertical slots 115 of the carrier beam, the locking clip can be slid downwardly in the slots 115 in the direction of arrow D to engage the side-by-side side flanges 107 of a pair of adjacent panels 105 to securely hold them in position on the carrier beam.

FIG. 7 also shows the locking of a last panel 105A to be installed in the second ceiling panel assembly 101 and the use of a tool 119 for accomplishing this. With the last to-be-installed panel 105A positioned on all the carrier beams 103 and with all the previously fitted panels 105 locked by sliding downwardly the locking clips 113 above them, the locking clips 113 on the carrier beams for the last to-be-installed panel 105A can no longer be reached by hand.

Locking of the last to-be-installed panel 105A is effected by first inserting the tool 119 between the abutting side flanges 107 of the last to-be-installed panel 105A and one of the longitudinally adjacent, previously installed panels 105B as indicated by arrow B. Then, the tool 119 is slid laterally towards an adjacent carrier beam 103 and a first upstanding locking clip 113 on the exterior lateral face 114 of its depending flange leg 111, between the two panels 105A, 105B to be fastened together first. The first locking clip 113 can then be engaged by means of a tab 121 extending frontally from about the middle of the locking clip, away from the one depending flange 111 of the adjacent carrier beam 103. The tab 121 is adapted to be accommodated in a recess 123 of the tool 119.

The tool 119 is conveniently formed from a flat metal, preferably steel, strip. The tool 119 is adapted to be moved towards the adjacent carrier beam 103, with the flat sides and recess 123 of the tool extending laterally, between the somewhat resilient abutting side flanges 107 of the two panels 105A, 105B to be fastened together first, without damaging them. After insertion of the tab 121 of the first locking clip 113, on the exterior lateral face 114 of the one depending flange 111 of the adjacent carrier beam 103, in the laterally oriented recess 123 of the tool 119, the tab 121 is moved downwardly in the direction of arrow D by moving the tool downwardly. This downward movement of the tab 121 and thereby the first locking clip 113 positions the abutting side flanges 107 of the two panels 105A, 105B, to be fastened together first, between a pair of downwardly-extending legs 125, 127 on opposite sides of the bottom of the first locking clip 113, which is the locking position of the locking clip 113 as described in more detail below with reference to FIG. 8.

After having moved the first locking clip 113 to its locking position relative to the two panels 105A, 105B to be fastened together first, the tool 119 is slid laterally away from the locking clip in accordance with arrow E, and the tool can thereafter be retracted by moving it downwardly in accordance with arrow F.

The same steps can then be repeated to lock the last to-be-installed panel 105A to the other longitudinally adjacent, previously installed panel 105B, using a second locking clip 113 on the adjacent carrier beam 103, between these two panels 105A and 105B to be fastened together second.

Thereafter, all of the above steps can be repeated to lock the last to-be-installed panel 105A to the two longitudinally adjacent, previously installed panels 105B, using the locking clips 113, between the panels 105A, 105B, on the other carrier beams 103, to securely hold the last to-be-installed panel 105A to the two longitudinally adjacent, previously installed panels 105B.

Figure 8:
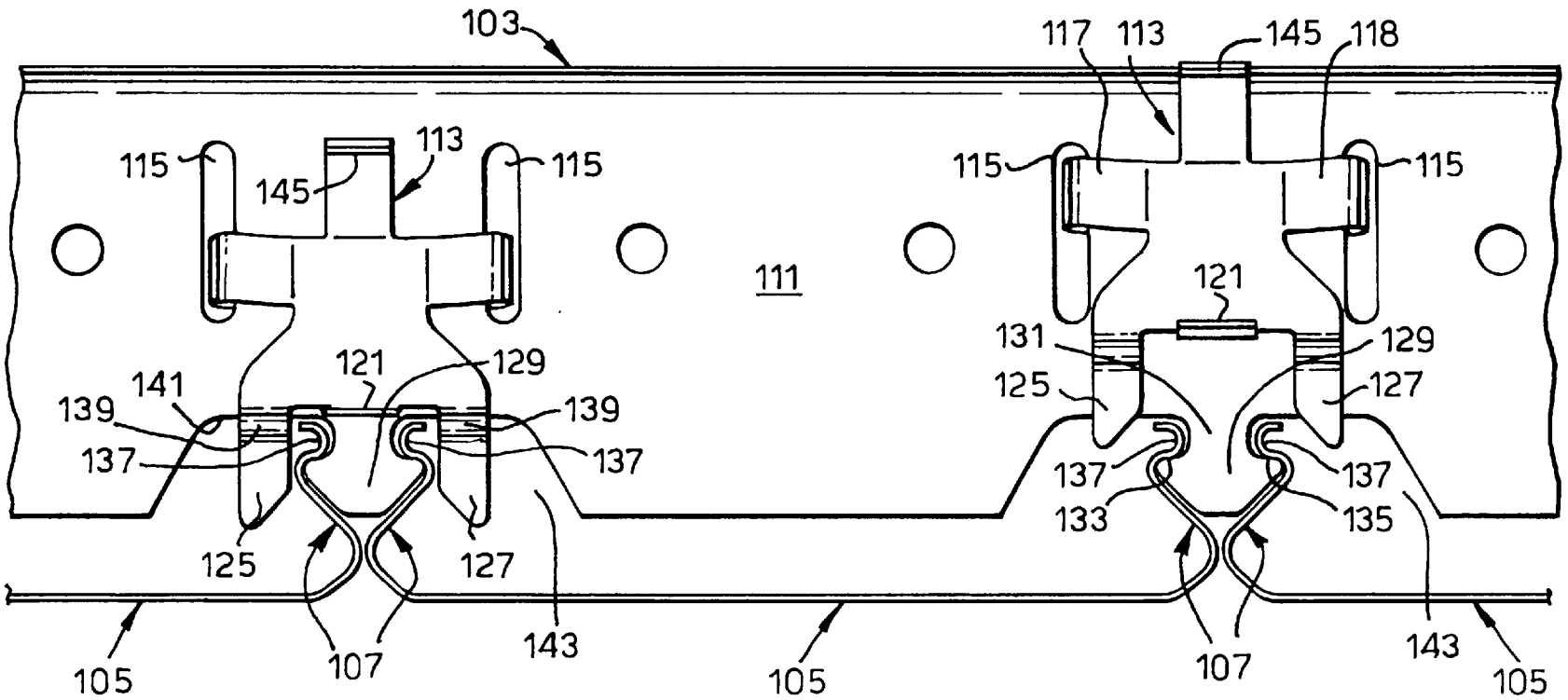
FIG. 8 is a side elevation of a portion of the second ceiling paneling assembly of FIG. 7, showing different positions of a panel locking clip of this invention.

FIG. 8 shows three adjacent panels 105 of the second ceiling paneling assembly 101. The abutting in-turned side flanges 107 of the panels 105 are engaged by support lugs 129 formed on the depending flange 111 of one of the carrier beams 103, which flange 111 carries the locking clips 113 on the one carrier beam 103. The support lugs 129 are spaced along the length of the carrier beam 103, and each support lug has a stem portion 131 and two oppositely extending, support surfaces 133, 135. The support surfaces 133, 135 are each spaced vertically from an adjacent portion of the depending flange 111 and are adapted to receive an outwardly directed bead 137 on the free edge of each of the confronting side flanges 107 of the adjacent panels 105.

FIG. 8 also shows two locking clips 113 on the one carrier beam 103. The right-hand locking clip 113 is shown in its uppermost or inactive position. The left-hand locking clip is shown in its lowermost or active position with its legs 125, 127 adjacent to, and on longitudinally opposite sides of, a pair of outwardly directed beads 137 of the confronting side flanges 107 of adjacent panels 105, thereby preventing the outwardly directed beads 137 of the adjacent panels 105 from becoming disengaged from the support lug 129. In this regard, at about the middle of the length of each leg 125, 127 is a frontally-extending knee portion 139. In the active position of the locking clip 113, each knee portion 139 engages a lower edge 141 of a recess 143 that is in the depending flange 111 of the carrier beam 103 and that surrounds the support lug 129. The knee portions 139 thereby hold the left-hand locking clip 113 in its lowermost, active position to lot prevent it from being accidentally dislocated from its locking position on the exterior lateral face 114 of the depending flange 111, holding together two side-by-side side flanges 107 of a pair of adjacent panels 105. Manual movement of each locking clip 113, between its inactive and active positions, is facilitated by a frontally-extending finger grip 145 on top of the locking clip.

Figure 9:
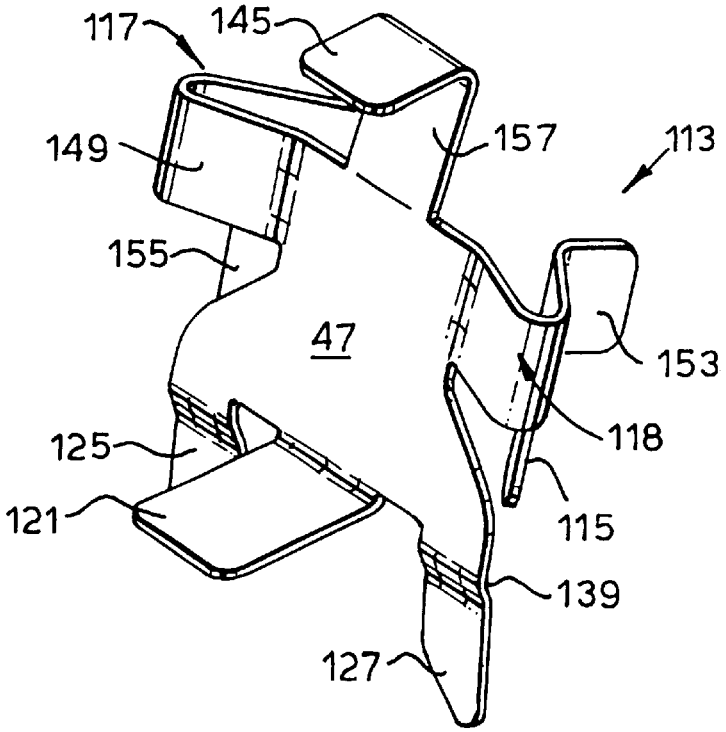
FIG. 9 is a perspective view of the panel locking clip from the same direction as in FIG. 7.
Figure 10:
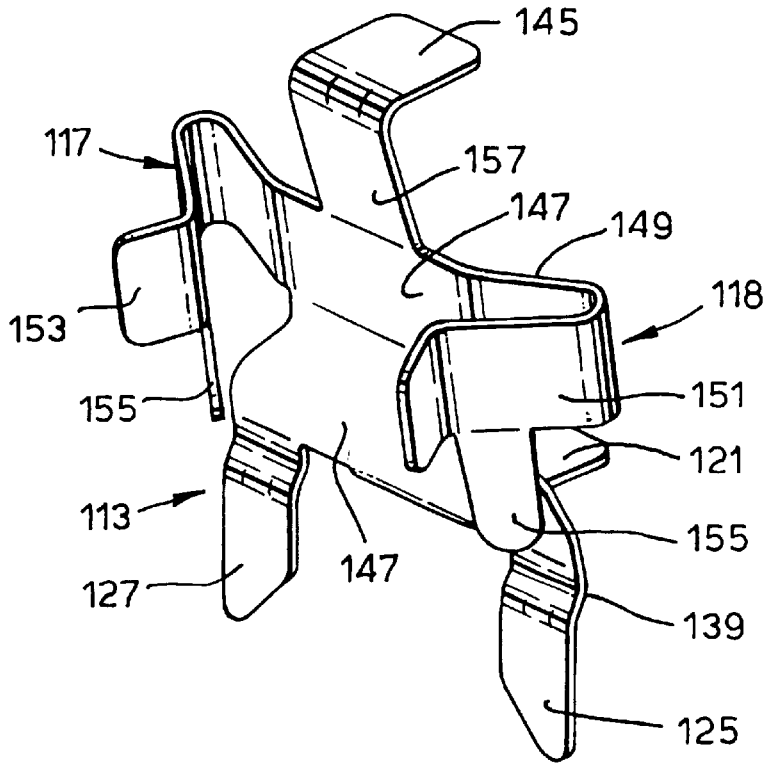
FIG. 10 is a perspective view of the panel locking clip as seen from an opposite direction from that of FIG. 9.

FIGS. 9 and 10 show the upstanding locking clip 113 in more detail from the front and back. The locking clip 113 has a main body 147, from which the pair of arms 117, 118 and the pair of legs 125, 127 extend generally in the plane of the main body. The arms 117,118 are on opposite sides of the main body 147 and extend generally away from its opposite sides. The legs 125,127 are on opposite sides of the bottom of the main body and extend generally downwardly. Also on the main body 147 is the frontally-extending tab 121, located vertically and horizontally between its arms 117, 118 and legs 125, 127, and on top of the main body portion is the frontally-extending finger grip 145. The arms 117, 118 each have a rear arm portion 149, an inwardly- and frontally-extending front arm portion 151 and a frontally-extending hand portion 153. Depending downwardly from the front arm portion 151 is a tongue 155 which is adapted to engage behind the carrier flange 111 at the bottom of the vertical slot 115 when the locking clip 113 is in its lowermost locked position. These tongues 155, together with the resilient legs 125, 17 and knee portions 139, ensure that the locking clip 113 is firmly held in position on the depending carrier flange 111, when in its locked position. When slid in the uppermost inactive position, the locking clip 113 is held only by the inwardly- and frontally-extending front arm portions 151. These front arm portions 151 also provide sufficient guidance to the locking clip 113 during the first portion of its downward sliding movement until its tongues 155 have reached the bottom of the vertical slots 115. Preferably, the lower end of each tongue 155 is rounded or chamfered to enable engagement with some resilient pressure. The function of the frontally-extending hands 153 is to provide guidance upon initial engagement with the carrier beam 103 as explained in connection with arrow A of FIG. 7.

FIGS. 9 and 10 also show that the finger grip 145 is spaced above the main body portion 147 by a neck 157. As seen in FIGS. 7 and 8, the neck 157 spaces the finger grip 145, so that it is flush with the top of the carrier body 109 so as to allow the unlocked position of the locking clips 113 to be readily recognisable, visually.

Figure 11:
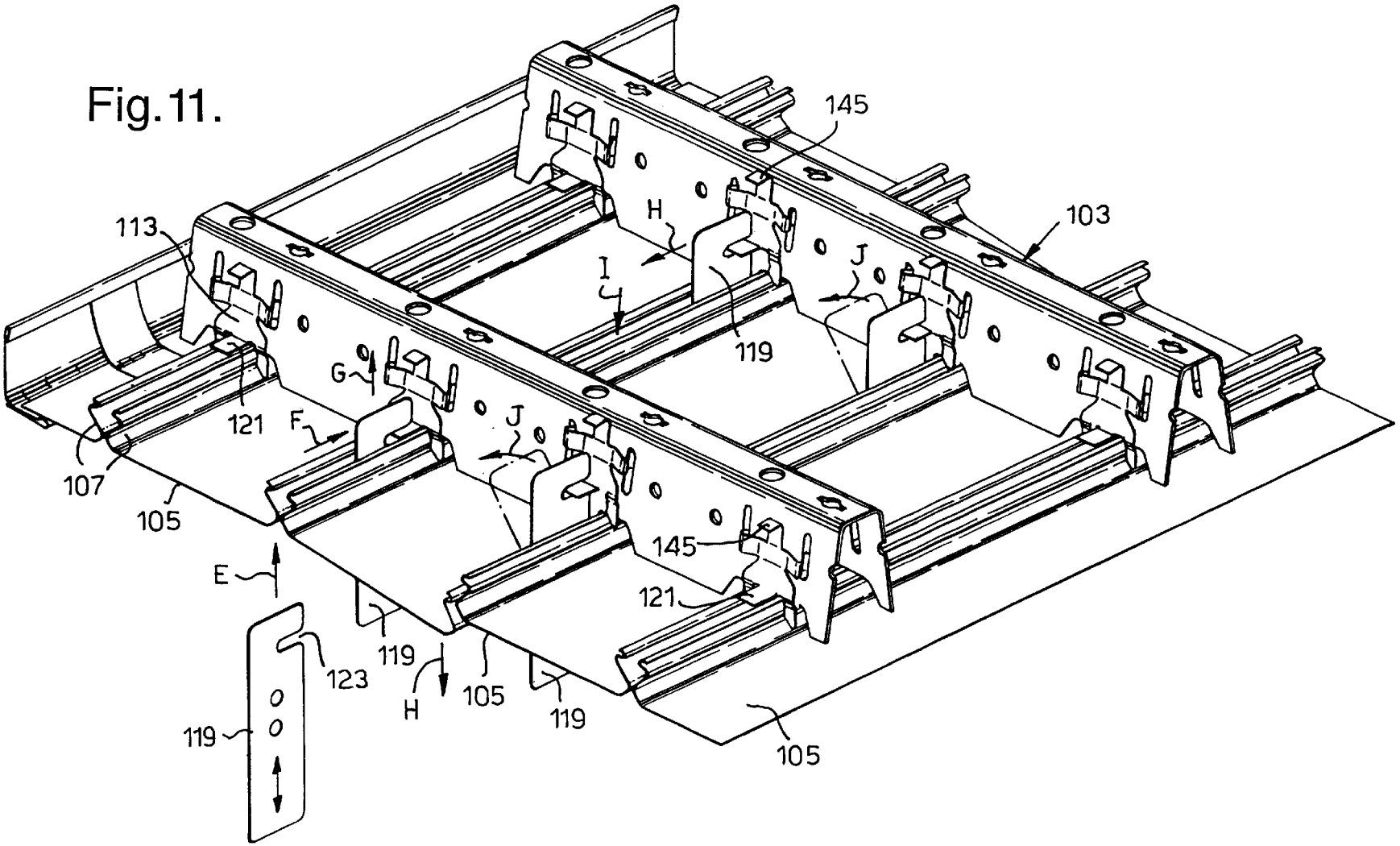
FIG. 11 is a perspective view, similar to FIG. 7, but showing the steps of removing a first panel from the fully installed, second ceiling paneling assembly of this invention.

FIG. 11 shows the demounting of a first panel 105 and the use of the tool 119 for this purpose. The tool 119 is first inserted in the direction of arrow E between the abutting side flanges 107 at the joint of neighboring panels 105, which will resiliently allow the flat strip-like tool 119 to pass between them. With the tool 119 far enough inserted between the adjacent side flanges 107, it can be moved in the direction of arrow F towards the adjacent carrier beam 103, so as to engage the tab 121 of the locking clip 113 in the recess 123 of the tool 119. With the tab 121 engaged in the recess 123, the tool 119 is moved further upwardly in the direction of arrow G, and this will then move the particular locking clip 113 to its unlocked position. As shown elsewhere in FIG. 11, retraction of the tool 119 after unlocking one of the locking clips 113 is first in the direction of arrow H to disengage the tab 121 from the recess 123 and thereafter in the direction of arrow I to retract the tool from between the adjacent panel flanges 107.

After the locking clips 113 on one side of the first panel 105 have all been unlocked in this manner, the tool 119 is similarly inserted between the abutting side flanges 107 at the opposite side of this first panel 105, to be removed. Subsequent to unlocking the locking clips 113 on this other side of the first panel 105, the tool 119, while still inserted between the abutting side flanges 107, is pivoted in the direction of arrow J to free the outwardly directed bead 137 of the panel from engagement with the confronting support lug 129. With the first panel removed, removing any further panels 105 is straight forward, as the other locking clips 113 can now each be reached manually and unlocked, as required, using their finger grips 145.

Further elements shown in FIGS. 1–11, such as the edge cover profile and the mounting holes in the carrier beams 3,103, which have not been described or referred to above, are conventional.

This invention is, of course, not limited to the above-described embodiments which may be modified without departing from the scope of the invention or sacrificing all of its advantages. In this regard, the terms in the foregoing description and the following claims, such as "longitudinal", "lateral", "vertical", "horizontal", "upstanding", "downwardly", "upwardly", "beneath", "bottom", "top", "front", and "rear", have been used only as relative terms to describe the relationships of the various elements of the panel end connector and locking clip of the invention for a ceiling or wall paneling assembly.

We claim:

1. A wall or ceiling panel system comprising in combination a pair of longitudinally extending elongate panels positioned in an end-to-end relationship and a panel connector for connecting adjacent longitudinal ends of said elongate panels, each panel having a pair of upstanding inturned flanges on opposite lateral sides of a central web portion and the panel connector having:

a base member with a first central body having, on laterally opposite sides, a first pair of marginal edges adapted to be engaged between the opposite inturned flanges of each of the elongate panels when the first central body overlies the central web portion of each panel; and a hold down member with a second central body having, on laterally opposite sides, a second pair of marginal edges adapted to be engaged between the opposite inturned flanges of each of the elongate panels when the second central body overlies the first central body; and wherein the base member and the hold down member are movable relative to one another and overlie the adjacent longitudinal ends of said panels.

2. The system of claim 1 wherein the second pair of marginal edges are connected to laterally opposite sides of the second central body of the hold down member by a pair of resilient side portions biasing the second pair of marginal edges away from the first pair of marginal edges.

3. The system of claim 1 wherein the base member and the hold down member are only laterally movable relative to one another.

4. The system of claim 1 wherein the second pair of opposite marginal edges of the hold down member is adapted to cooperate with the opposite inturned flanges of each of the elongate panels to laterally and vertically center the hold down member on the elongate panel and on the base member, said inturned flanges having a generally U-shaped cross-section with generally inwardly-directed free end portions confronting one another.

5. The system of claim 1 wherein the first pair of opposite marginal edges of the base member are adapted to laterally center the base member between the opposite inturned flanges of the pair of elongate panels.

6. The system of claim 1 wherein the base member has a first longitudinal length, parallel to its first pair of opposite marginal edges, and the hold down member has a second longitudinal length, parallel to its second pair of opposite marginal edges and shorter than the first length.

7. The system of claim 1 wherein the first central body of the base member and the second central body of the hold down member are each substantially flat.

8. The system of claim 1 wherein the first and second pairs of marginal edges are upstanding.

9. The system of claim 1 wherein the first central body of the base member has a downwardly and longitudinally extending central depression engageable with said central web portions of the adjacent pair of panels at their longitudinal ends to force the central web portions into a slight curvature.

10. A panel connector for connecting adjacent longitudinal ends of a pair of longitudinally-extending elongate panels in an end-to-end relationship, where each panel has a pair of upstanding inturned flanges on opposite lateral sides of a central web portion, the panel connector comprising:

a base member with a first central body having, on laterally opposite sides, a first pair of marginal edges adapted to be engaged between the opposite inturned flanges of each of the elongate panels when the first central body overlies the central web portion of each panel; and a hold down member with a second central body having, on laterally opposite sides, a second pair of marginal edges adapted to be engaged between the opposite inturned flanges of each of the elongate panels when the second central body overlies the first central body; and wherein the second pair of opposite marginal edges are connected to laterally opposite sides of the second central body of the hold down member by a pair of resilient side portions biasing the second pair of opposite marginal edges away from the first pair of opposite marginal edges and wherein the second pair of opposite marginal edges are spaced away from the first pair of opposite marginal edges.

11. The panel connector of claim 10 wherein the base member and the hold down member are movable relative to one another.

12. The panel connector of claim 11 wherein the base member and the hold down member are only laterally movable relative to one another.

13. The panel connector of claim 12 wherein the second pair of opposite marginal edges of the hold down member is adapted to cooperate with the opposite inturned flanges of each of the elongate panels to laterally and vertically center the hold down member on the elongate panel and on the base member, said inturned flanges having a generally U-shaped cross-section with generally inwardly-directed free end portions confronting one another.

14. The panel connector of claim 13 wherein the first pair of opposite marginal edges of the base member are adapted to laterally center the base member between the opposite inturned flanges of the pair of elongate panels.

15. The panel connector of claim 14 wherein the base member has a first longitudinal length, parallel to its first pair of opposite marginal edges, and the hold down member has a second longitudinal length, parallel to its second pair of opposite marginal edges and shorter than the first length.

16. A wall or ceiling panel assembly comprising: at least one pair of adjacent longitudinally-extending elongate panels having adjacent longitudinal ends in an end-to-end relationship, where each panel has a pair of upstanding inturned flanges on opposite lateral sides of a central web portion; and the panel connector of any of claims 1, 10, 11, or 20 wherein said panel connector overlies the adjacent longitudinal ends of said at least one pair of panels.

17. The assembly of claim 16 wherein the central web portion of each elongate panel is substantially flat.

18. The assembly of claim 17 wherein the opposite inturned flanges of each of the elongate panels have a generally U-shaped cross-section with generally inwardly directed free end portions, confronting one another, to laterally and vertically center the hold down member on the elongate panels and on the base member, between them.

19. The assembly of claim 16 wherein the opposite inturned flanges of each of the elongate panels have a generally U-shaped cross-section with generally inwardly directed free end portions, confronting one another, to laterally and vertically center the hold down member on the elongate panels and on the base member, between them.

20. A panel connector for connecting adjacent longitudinal ends of a pair of longitudinally-extending elongate panels, where each panel has a pair of upstanding inturned flanges on opposite lateral sides of a central web portion; the panel connector comprising:

a base member with a first central body having, on laterally opposite sides, a first pair of marginal edges adapted to be engaged between the opposite inturned flanges of each of the elongate panels when the first central body overlies the central web portion of each panel;

a hold down member with a second central body having, on laterally opposite sides, a second pair of marginal edges adapted to be engaged between the opposite inturned flanges of each of the elongate panels when the second central body overlies the first central body;

wherein the base member and the hold down member are movable relative to one another;

wherein said base member further includes tabs;

wherein said hold down member further includes apertures; and wherein the base member and the hold down member are physically attached to each other by said tabs on said base member engaging said apertures in the hold down member.

21. A panel connector for connecting adjacent longitudinal ends of a pair of longitudinally-extending elongate panels in an end-to-end relationship, where each panel has a pair of upstanding inturned flanges on opposite lateral sides of a central web portion; the panel connector comprising:

a base member with a first central body having, on laterally opposite sides, a first pair of marginal edges adapted to be engaged between the opposite inturned flanges of each of the elongate panels when the first central body overlies the central web portion of each panel;

a hold down member with a second central body having, on laterally opposite sides, a second pair of marginal edges adapted to be engaged between the opposite inturned flanges of each of the elongate panels when the second central body overlies the first central body;

wherein the second pair of opposite marginal edges are connected to laterally opposite sides of the second central body of the hold down member by a pair of resilient side portions biasing the second pair of opposite marginal edges away from the first pair of opposite marginal edges;

wherein the second pair of opposite marginal edges are spaced away from the first pair of opposite marginal edges;

wherein the base member and the hold down member are movable relative to one another;

wherein the base member and the hold down member are only laterally movable relative to one another;

wherein the second pair of opposite marginal edges of the hold down member are adapted to cooperate with the opposite inturned flanges of each of the elongate panels to laterally and vertically center the hold down member on the elongate panels and on the base member, said inturned flanges having a generally U-shaped cross section with generally inwardly-directed free end portions confronting one another;

wherein the first pair of opposite marginal edges of the base member are adapted to laterally center the base member between the opposite inturned flanges of the pair of elongate panels;

wherein the base member has a first longitudinal length, parallel to its first pair of opposite marginal edges and the hold down member has a second longitudinal length parallel to its second pair of opposite marginal edged and shorter than the first length; and wherein the base member further includes tabs and the hold down member further includes apertures and wherein the base member and the hold down member are physically attached to a each other by said tabs on said base member engaging in said apertures in the hold down member.

22. The panel connector of claim 21 wherein the first central body of the base member and the second central body of the hold down member are each substantially flat.

23. The panel connector of claim 22 wherein the first and second pairs of marginal edges are upstanding.

24. The panel connector of claim 23, wherein the first central body of the base member has a downwardly- and longitudinally-extending central depression adapted to the underlying central web portions of the adjacent pair of panels at their longitudinal ends to urge the central web portions in that area into a slight curvature.

* * * * *